United States Patent [19]

Oess et al.

[11] 4,020,381

[45] Apr. 26, 1977

[54] CATHODE STRUCTURE FOR A MULTIBEAM CATHODE RAY TUBE

[75] Inventors: Frederick G. Oess; Michael Peshock, Jr., both of Richardson, Tex.

[73] Assignee: Texas Instruments Incorporated, Dallas, Tex.

[22] Filed: Jan. 15, 1976

[21] Appl. No.: 649,288

Related U.S. Application Data

[62] Division of Ser. No. 530,624, Dec. 9, 1974, Pat. No. 3,935,500.

[52] U.S. Cl. ..... 313/302; 313/304; 313/307; 313/338; 313/351

[51] Int. Cl.² ..... H01J 1/46; H01J 21/10

[58] Field of Search ..... 313/302, 304, 309, 338, 313/351, 346

[56] References Cited

UNITED STATES PATENTS

| | | | |
|---|---|---|---|
| 3,247,420 | 4/1966 | Mayer | 313/338 X |
| 3,755,704 | 8/1973 | Spindt et al. | 313/309 |
| 3,767,968 | 10/1973 | Ogle | 313/351 |
| 3,789,310 | 1/1974 | Mancebo | 313/351 |

FOREIGN PATENTS OR APPLICATIONS

| | | | |
|---|---|---|---|
| 688,956 | 3/1953 | United Kingdom | 313/338 |

*Primary Examiner*—Saxfield Chatmon, Jr.
*Attorney, Agent, or Firm*—Harold Levine; James T. Comfort; Gary C. Honeycutt

[57] ABSTRACT

A flat cathode ray tube device is provided for display of information by response to an electron beam of a phosphor coating on a face plate. A monolithic structure includes an *x–y* matrix of electron source cathodes and a pair of grid arrays successively spaced from the matrix with holes therethrough adjacent to and aligned with the cathodes selectively to form and individually control the intensity of an electron beam from each of said cathodes. Deflection control structure has holes through which the beams may pass with a set of *x–y* deflection electrodes associated with each of the holes for *x–y* control of the trajectory of each of the beams. A support plate forms the base of the monolithic structure with the cathodes mounted thereon and a face plate structure marginally sealed to the support plate provides a vacuum tight envelope housing the monolithic structure.

7 Claims, 10 Drawing Figures

CATHODE STRUCTURE FOR A MULTIBEAM CATHODE RAY TUBE

This is a division of application Ser. No. 530,624, filed Dec. 9, 1974, now U.S. Pat. No. 3,935,500.

This invention relates to flat cathode ray tube having multiple electron beams with selective deflection means for each of the beams. In a further aspect, the invention relates to establishment and control of multiple electron beams.

Cathode ray tubes (CRT) used for display purposes in general are large volume devices housing structure for forming and deflecting and using an electron beam. Conventional television systems are bulky primarily because depth is necessary for an electron gun plus the associated deflection system.

Information systems generally, and weapon systems specifically, depend upon effective display of information upon which a viewer must act in situations of peril. CRT devices are among the many types of systems used to present such data. CRT systems are more versatile than many other display devices in that they permit presentation not only of alphanumeric data but also of full range analog data in black and white as well as in color.

There exists the need for a flat cathode ray tube, i.e., a tube in which the ratio of display area to enclosed volume is greatly minimized relative to existing devices. The ideal would be a thin plate or panel on which there would appear such information as is designated by input digital or analog input signals.

One approach to the problem is represented by a system described and claimed in U.S. Pat. No. Re. 27,520 to Huftberg et al. This system employs a digitally addressed flat panel display. A dot matrix display therein involves control of an on-off electron beam for each dot. Decoding is accomplished by selective addressing of a series of apertured scanning plates to turn the individual beams on and off as desired. An area type of cathode is employed as a source of electrons for a multiplicity of beams.

In contrast to prior systems. the present invention employs a monolithic stack in which electron beams are formed and through which the beams are selectively projected onto a phosphor coated face plate with control means in the stack for simultaneously controlled *x–y* deflection for all the beams. The invention is directed, in one aspect, to a new approach to the manufacture of alphanumeric displays and flat color television tubes. In a further aspect, the invention involves a sandwiched full gun construction for an *x–y* matrix cathode ray tube. In a further aspect, it relates to a sandwiched type tube construction for large area matrix type CRT devices. In a further aspect, it involves a new and novel heater cathode structure for matrix type CRT devices. In a further aspect, it involves a novel beam deflection system for selective scanning of discrete areas of a face plate by each of the beams.

Provided is an *x–y* matrix of electron sources located in a common plane with a pair of arrays of grid electrodes which have orthogonal electrodes with holes therethrough adjacent to and aligned with the cathodes for control of the intensity and shape of beams from the cathodes. A drift stage member of conductive character is positioned adjacent to the grid arrays with holes through which the beams may pass. A set of *x–y* deflection electrodes for each of the beams is positioned downstream of the drift space member. The foregoing, formed as a monolithic structure, may be housed within a flat envelope having a phosphor coating on the surface onto which the electron beams are accelerated.

The novel features believed characteristic of the invention are set forth in the appended claims. The invention itself, however, as well as further objects and advantages thereof, will best be understood by reference to the following detailed description of an illustrative embodiment taken in conjunction with the accompanying drawings, in which:

FIG. 1

Figure 1:
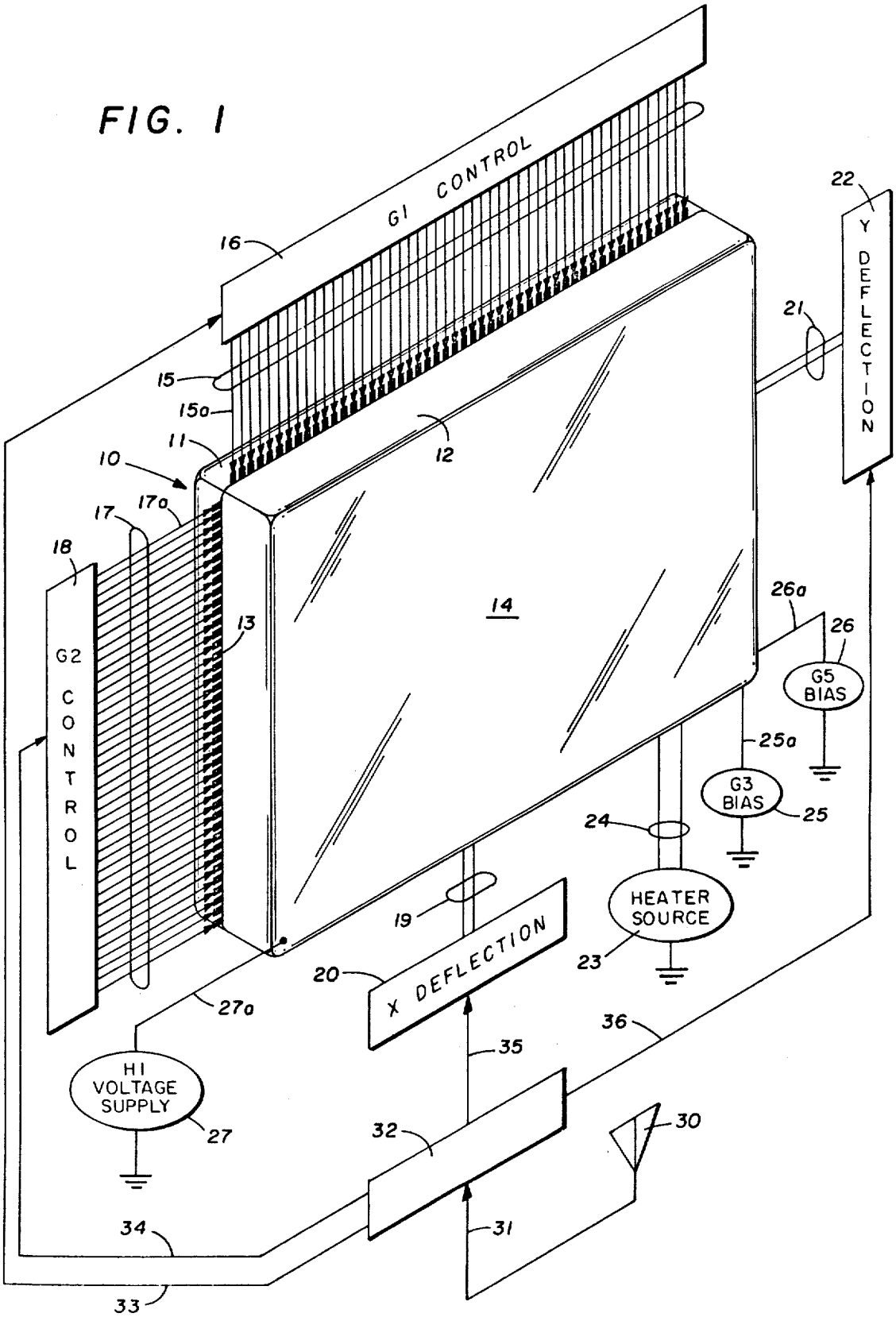
FIG. 1 is an isometric view of an embodiment of the invention.

Referring now to FIG. 1, a system embodying the present invention is illustrated wherein a flat tube 10 is provided. A back plate 11 and a front target plate 12 are sealed along a common boundary 18 to form an enclosure which may be evacuated. The target plate 12 has a phosphor coated surface 14 on which there is to appear a visual display produced by reaction to impinging electron beams on the inner surface of face plate 12. A plurality of control terminals immerge from the tube along the sealing line 13. A first set of leads 15 interconnect terminals extending through the top of tube 10 and a control unit 16 for a set of G1 grids. A second set of control terminals is connected by leads 17 to a G2 control unit 18. A third control terminal is connected by leads 1 to an *x*-axis modulation control unit 20. A fourth control terminal is connected by leads 21 to a *y*-axis modulation control unit 22. A source 23 supplies heater current by way of leads 24. A DC source 25 is connected to bias a G3 grid. A source 26 serves to supply a G5 grid. A high voltage supply 27 serves as the accelerating voltage for a beam formed in the system of grids G1-G5.

As in a conventional television system, a signal from an antenna 30 or other information source is supplied by way of channel 31 in a control unit 32 which is connected by way of channels 33–36 to control units 8, 16, 18, 20 and 22, respectively.

FIG. 2

Figure 2:
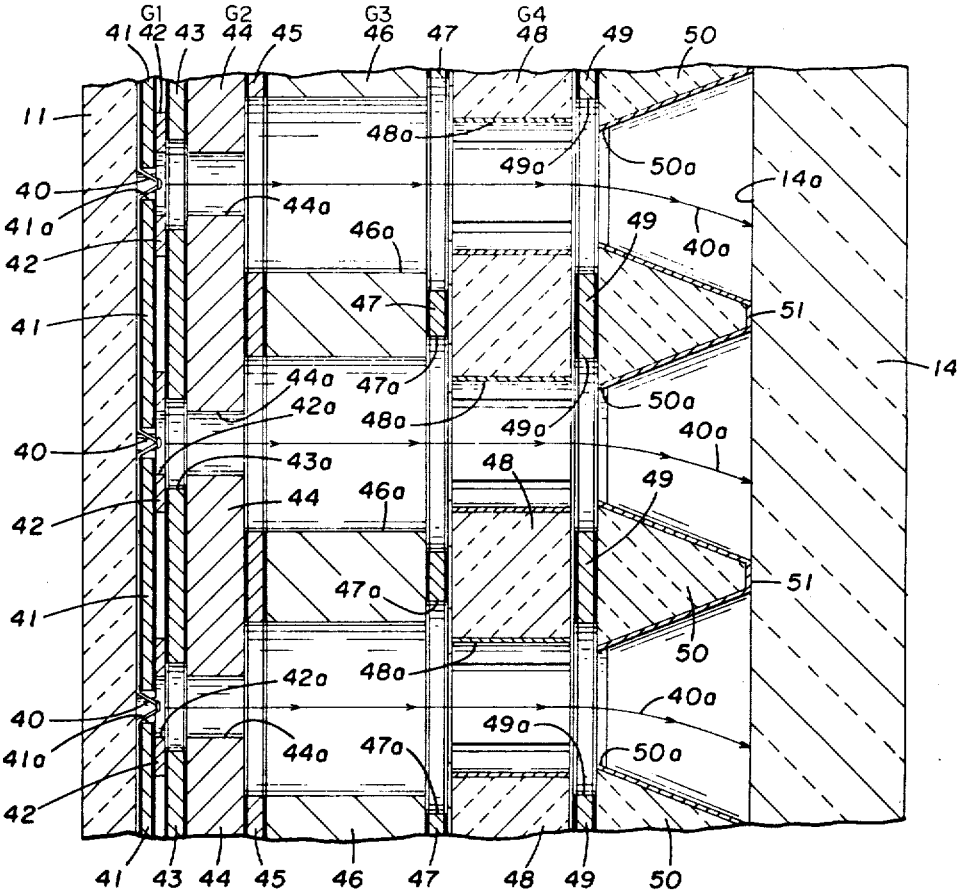
FIG. 2 is a fragmentary sectional view of a monolithic structure employed in the tube of FIG. 1.

FIG. 2 illustrates one form of suitable structure for the system of FIG. 1. Base plate 11 supports an *x–y* matrix of heater cathodes 40. The cathodes are supported from one surface of the base plate 11 and extend as risers away from base plate. They are of inverted V shape having at the peak a specially treated portion from which electrons are emitted.

Insulating positioning plate 41 provides apertures 41*a* for the heaters and thus serve to position and support the heater cathodes 40. An electrode array 42 of G1 electrodes is positioned adjacent the surface of the plate 41. Holes 42*a* in electrode 42 are aligned with heater cathodes 40. Holes 42*a* are slightly larger than hole 41*a*. If the cathode 40 is operated at ground potential, the voltage on the G1 array 42 may be switched from a minus 30 volts typically to 0 volt to turn on the beam of electrons from cathode 40 for pulse width modulation or may be switched to an intermediate value for amplitude modulation.

A spacer 43 is positioned next adjacent the gate G1 array 42 and has apertures 43*a* therein coaxial with apertures 42*a*. A G2 electrode array 44 is positioned next adjacent spacer 43. Apertures 44*a* extend through the electrode of array 44 coaxial with apertures 42*a*. Apertures 44*a* are smaller than apertures 43*a* and serve as a control for the electron beams from cathode 40. A third spacer 45 is positioned next adjacent the electrode 44 with a drift space member 46 adjacent the spacer 45. Apertures 45*a* and 46*a* extend through members 45 and 46, respectively, coaxial with apertures 42*a*. The apertures 45*a* and 46*a* are much larger than apertures 44*a*. The next member in the structure is a spacer 47 having apertures 47*a* therein of greater diameter than apertures 46*a* and coaxial therewith.

Next, a beam deflection unit 48 is provided with apertures 48*a* therein which are metallized in segmented form so that the beam passing therethrough may be deflected in the *x* and *y* directions. Apertures 48*a* typically are smaller than apertures 46*a*.

A spacer 49 is positioned next adjacent the member 48*a* with apertures 49*a* thereto larger than apertures 48*a*. A final buffer electrode structure 50 is provided with apertures 50*a* extending therethrough coaxial with apertures 42*a*. Structure 50 is characterized by elongated ribs 51 extending in the x direction.

Face plate 14 is provided with the inner surface 14*a* coated with a phosphor and electroded in the usual manner in cathode array technology so that a high potential applied thereto will serve to accelerate electrons in the electron beam 40*a* to impinge surface 14*a* and thereby produce a visible reaction to the impingement of the electron beam.

In one embodiment ribs 51 serve to support the face plate 14 against atmospheric pressure so that evacuation of the interior of the envelope formed by the base 11 and the face plate 14 will not result in breakage of a relatively thin face plate. Ribs 51, because of their height, provide second level drift spaces for the beams. For smaller diameter tubes, a mesh structure may be interposed between the face plate and electrode 51 in order to extend the drift space and prevent dead areas on the screen because the ribs and the deflection limitation caused thereby.

FIG. 3

Figure 3:
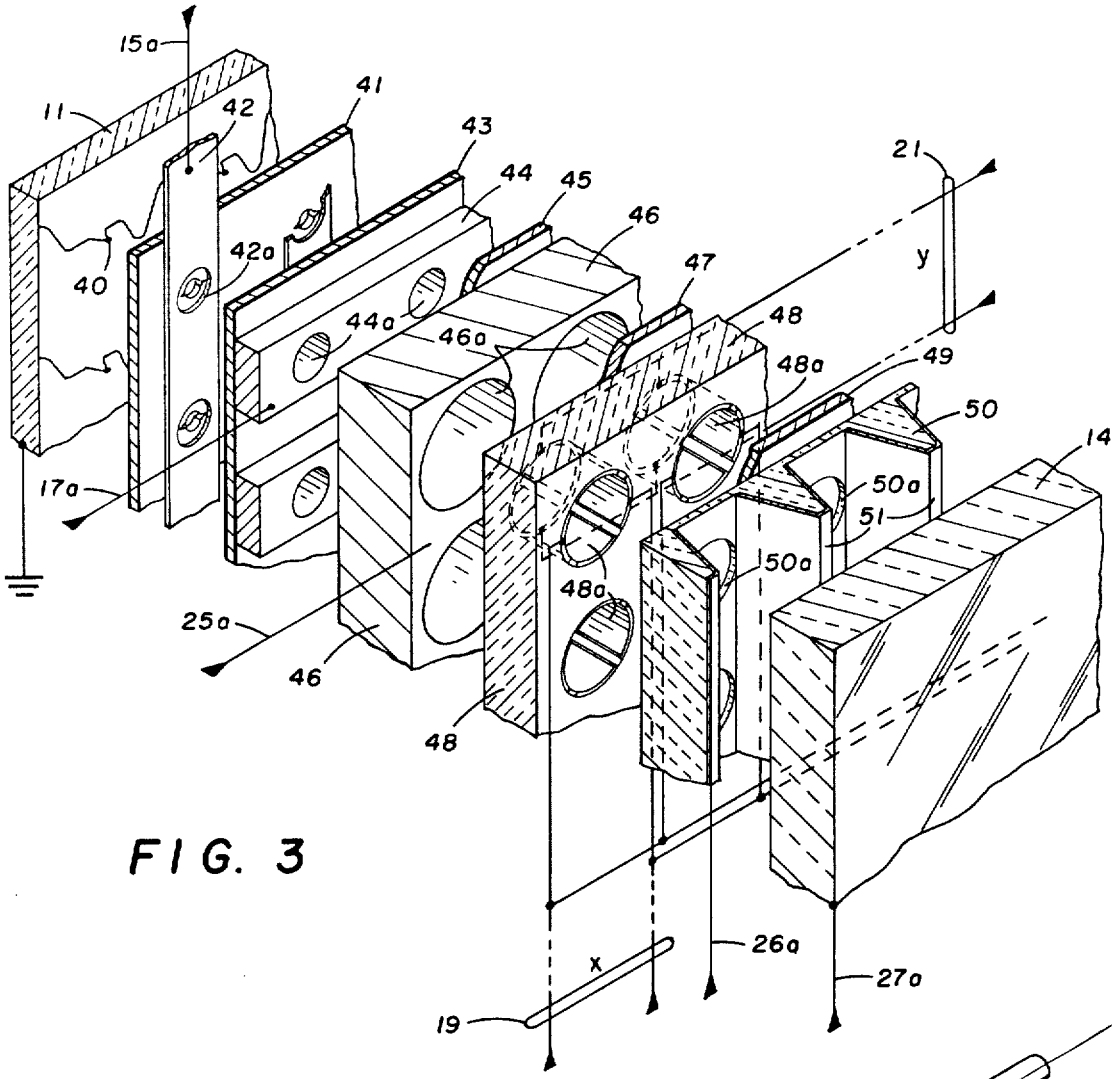
FIG. 3 is an exploded view of a portion of the stack of FIG. 2.

The structure of FIGS. 1 and 2 may be further understood by referring to the exploded view of FIG. 3. The base plate 11 supports the heater cathodes 40 at a point aligned with holes 42*a* in electrode array 42. In an orientation in which the face of the tube is in a vertical plane, electrodes of array 42 extend in the *y* (vertical) direction in the stack. Electrodes of array 44 have holes 44*a* with holes 42*a* and extend in the *x* (horizontal) direction. The drift space members 46 has holes 46*a* aligned with holes 42*a*. The member 48*a* is provided with small apertures 48*a* with segmented electrodes lining the surface of the apertures 48*a*. The final buffer electrode 50 with support ridges 51 has apertures 50*a* therein aligned with apertures 42*a*.

A conductor 15*a* is connected to electrode 42. A conductor 17*a* is connected to electrode 44. A conductor 25*a* is connected to the G3 electrode plate 46. A pair of conductors 19 interconnect all the horizontal deflection electrodes in apertures 48*a*. A pair of conductors 21 interconnect all the vertical deflection electrodes in apertures 48*a*. A conductor 26*a* is connected to the final buffer electrode 50 and a conductor 27*a* is connected to the high voltage electrode on member 14.

It will be seen that each electrode 42*a* spans a column of heaters and has a column of apertures 42*a* therein. Each electrode 44 spans a horizontal row of cathodes. In conventional CRT nomenclature the electrode 42 serves as the first grid. The electrode 44 serves as the second grid. The two pairs of electrodes in apertures 48*a* serve as the horizontal and vertical beam deflection plates. In the embodiment of the invention shown in FIGS. 1–3, heater cathodes 40 may be spaced in an *x–y* matrix on 0.10 inch centers. In a four inch by five inch display such as shown in FIG. 1, there would be provided a 40 by 50 element array of cathodes or 2,000 cathodes with provision for forming and controlling 2,000 separate electron beams. A ten inch diagonal display unit would have a matrix of 60 by 80 elements.

In the formation of the multiplicity of beams, the G1 electrodes 42 serve to control beam intensity in an on/off digital sense or in an analog sense depending upon the signal applied as by way of channel 15*a*. As above indicated, the voltage would be at zero potential or ground potential for beam fully on, and would be at minus thirty volts to shut off the beam.

The electrodes of array 44 serve as the second grid and as accelerators for the beams. The combination of cathodes 40 and electrode arrays 42 and 44 form triode elements of a gun whose action is to form, focus and control the electron beam 40*a*. The G3 electrode 46 is a uni-potential metallic plate whose purpose is to serve as a drift space and to form a lens downstream of the G2 electrode array 44 that may be used to control the shape of beam 40*a*. The electrodes in the G4 plate 48 serve as bidirectional deflection plates for the beam 40*a*. The G5 element 50 serves as a drift space and also serves as a beam grid to provide for further lensing action.

In operation:

Heater cathodes 40 remain on at all times.

G1 grid 42 controls the beam current and the column selection. A sufficient negative bias on this grid prevents the electron introduction into the stack. Amplitude modulation (increase or decrease of electron flow) is attained by the imposition of an information signal upon the bias voltage. Pulse width modulation is possible along with amplitude control.

G2 grid 44 controls the row selection. All electron beams passing grid 42 will be modulated in this row at the same time. In other words — one line of information, alphanumeric characters for example, may be written at a time.

G3 grid 46 is a collimator or electron lens in the stack. Its function is to squeeze in the electron beam so that the spot size on the screen is acceptable in diameter.

G4 grid 48 consists of two pairs of electrodes in each aperture 48*a*. One pair is to position the beam in the *y* or vertical direction. The beam will remain at a predetermined vertical position until a given horizontal line has been completely written. The deflection voltage is then lowered to establish the next line position. The *x* or horizontal deflector plate sweeps the electron beam through its successive steps. The size of the $x$ and $y$ areas upon the screen typically is 100 mils by 100 mils or an area of 0.01 square inches. In a 10 inch diagonal screen, 4,800 such very small areas typically form the presentation.

G5 grid 50 is the final buffer. This buffer as energized constitutes the electron beam accelerator. Sufficient impetus is provided to make the phosphor give off light at the impact point. Constant accelerating voltage applied to the anode on face plate 14 typically is of the order of 17,000 volts.

As shown in FIG. 2, the structure is monolithic. Base plate 11 may be glass or ceramic. Support plate 41 may be of metal with an insulation layer thereon. G1 electrodes of array 42 are conductors. An insulated metal spacer 43 supports G2 electrode array 44 the electrodes of which are conductors. A spacer 45, of insulation coated metal, supports G3 grid 46 which is a conductor. An insulation coated metal spacer 47 supports G4 conductive metal body 48. An insulation coated metal spacer 49 supports G5 body 50 formed of a conductive coated material. All the plates may be suitably insulated as by an $SiO_2$ coating. They may be fused together to form a monolithic structure which provides resistance to air pressure on the evacuated envelope and reduces problems that otherwise would be due to outgassing.

FIG. 4

Figure 4:
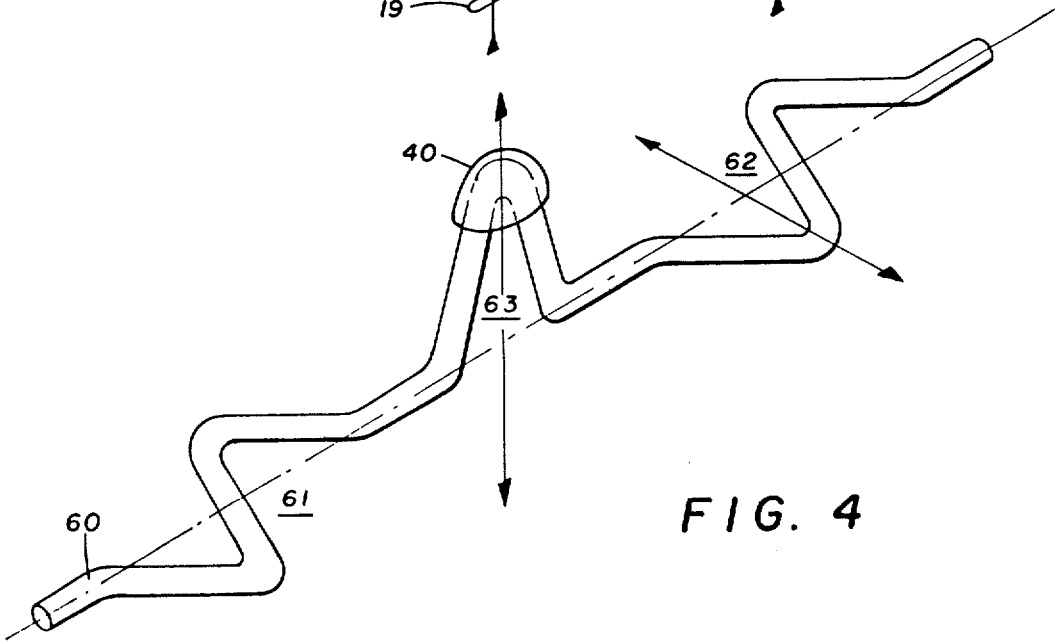
FIG. 4 illustrates a cathode configuration employed in the system of FIG. 1.

FIG. 4 is a greatly enlarged view of a portion of the heater cathode structure 40. In a preferred embodiment a cylindrical conductor 60 is provided with deviations 61 and 62 in the plane of the face of plate 11, FIGS. 2 and 3. The deviations are located on opposite sides of a riser 63 having legs which lie in a plane perpendicular to the face of plate 11. The peak of each riser 63 is coated to form a cathode structure 40 specially suited for electron emission when heated. Preferably, all of the portions of the cathode except the hairpin like riser 63 are in contact with a conductive body of such cross sectional area that only the riser 63 will be subject to heating and will thus dissipate power primarily by heating the coating at the peak of each riser 63.

FIG. 5

Figure 5:
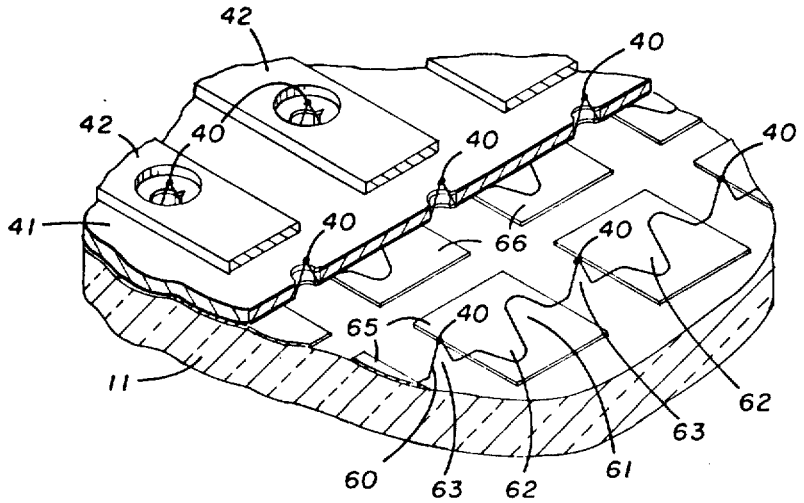
FIG. 5 illustrates a cathode assembly embodied in the system of FIG. 1.

FIG. 5 illustrates an assembly of a cathode matrix. It will be noted that the risers 63 of a first cathode array are positioned between pads 65 of a first row formed on the surface of plate 11. Risers of a second cathode array are positioned between pads 66 of a second row. The pads 65 are conductive and provide support for the horizontal courses 61 and 62 of the heater conductor. Spacer 41 is a plate provided with holes having V shaped notches, oppositely directed in alignment with the cathode conductor 60. The notches serve to position and to support risers 63.

By way of example, the cathode structure may be of thoriated tungsten wire where low emission is permissible, i.e., 3 amps/cm$^2$ peak. It may be of 97% tungsten 3% rhunium wire with a triple oxide emitter coating if high emission is necessary, i.e., 5 amps/cm$^2$ peak. Typically, current flow through each heater cathode wire of 25 miliamps would occur at 0.596 volt. The heater as mounted has alternating zones of low and high resistivity. The resistivity of the wire preferably is about $5.5 \times 10^{-2}$ ohms mm$^2$/m at the coldest portion and $29.2 \times 10^{-2}$ mm$^2$/m at the riser 63. The low resistance area is provided by pads 65 and may be formed of a conductive frit having such cross sectional area that no heating occurs in the wire 60. The cathode support pads 65 of the first row may be continuous in the direction perpendicular to the course of the cathode conductor 60. That is, each of pads 65 may be integral with the pads 66 in the second row. When the pads are thus integral, i.e., formed in strips, the resistance of cathode wire 60 in areas contacting the frit pads effectively is very low. Thus, the heat sinking ability of the rows of frit pads 65–66 and the support plate 41 permit peaking of the temperature at the top of each heater riser 63 while maintaining pads 65–66 at about ambient temperature.

In the system thus far described, the entire gun structure is axially symmetrical. Preferably the cathode is operated not as the most negative element in the stack to limit cathode ion bombardment. The G1 grid 42 and the G2 grid 44 serve as beam switching elements operating at reasonably low voltages. The G1 switching voltage will be of the order of 15 to 30 volts and the G2 voltages may be of the order of 75 to 150 volts for the geometry shown in FIG. 2. Because of the proximity of the cathode 40 to the remaining elements of the gun system, instantaneous cathode loading will be enhanced resulting in a high highlight luminence at the screen. The time integrated cathode loading on the other hand is desirably low because cathode current flow ceases when an element is not in operation, i.e., when the switching voltages on the G1 grid 42 or G2 grid 44 cut off the flow of current from the cathode 40. The spacers 43 and 45 in the triode sector of the structure are very far removed from the active electrode areas of grids 42 and 44 and are therefore far removed from the beam trajectory. Because of this, they represent essentially zero field influence since as it will be recalled, the size of the holes in grids 42 and 44 is 0.010 inch and the hole pitch is of the order of 0.100 inch. The deflectors in the G4 grid 48 minimize the number of elements required for a television application while providing for full screen display.

However, it will be noted from FIGS. 2 and 3 that a full screen presentation will not be possible because of the contact areas 51 at the face plate 14. A full screen display may be be provided utilizing the system illustrated in FIG. 6.

FIG. 6

Figure 6:
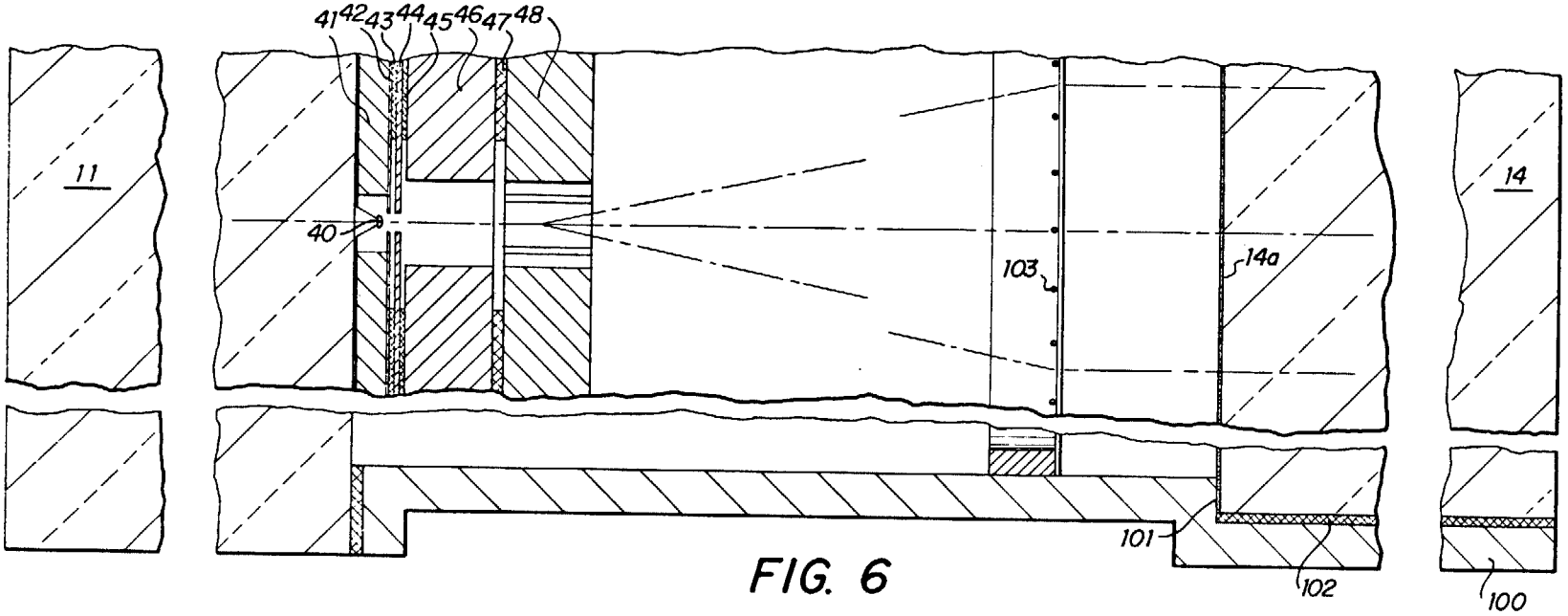
FIG. 6 illustrates an embodiment wherein the face plate is edge supported.

In the system of FIG. 6, like parts have been given the same reference characters as in FIGS. 1–5. In this system the tip of cathode 40 is spaced behind the plane of the back face of the G1 grid 42. The diameter of the holes through grids 42 and 44 are very small compared to the diameter of the holes through spacers 43 and 45. The diameter of the holes through grids 46 and 48 are about triple the diameter of the holes in grids 42 and 44. The thickness of G3 grid 46 and G4 grid 48 are about equal and roughly correspond to the diameter of the holes therethrough.

Base plate 11 abuts one end of a metal skirt 100. Face plate 14 is mounted within the other end of the metal skirt 100, resting on a shoulder 101 and sealed to skirt 100 by a suitable glass frit 102. A conventional screen **14*a* on the inside face of plate 14 responds to electron impingement to produce the desired visual display. Skirt 100 withstands the compressive forces due to atmospheric pressure on base plate 11 and face plate 14. An isolation mesh screen 103 is mounted between G4 grid 48 and face plate 14. Mesh 103 is secured on a ring 104 which is secured to the inside of skirt 100. Isolation mesh 103 serves to modify the electric fields along the paths of the electron beams to cause the trajectories to impinge the screen 14***a* perpendicularly.

In the embodiment of FIG. 6, representative values of the parameters involved for a 10 inch diameter screen may be:

Skirt 100 preferably will be of a metal of from 0.015 to 0.025 inch thick and made of material such as modified stainless steel generally known in the industry by the designation No. SS446. A particularly suitable material is manufactured by Universal Cyclops of Pittsburgh, Pa. and identified as metal sealing alloy No. 2810NC or 2810N. Another suitable metal is a metal sealing alloy No. 45–6 manufactured and sold by Carpenter Technology Corporation of Reading, Pa.

The face plate 14 of about one-half inch thickness will withstand the pressures involved when the system is evacuated and is made of glass such as presently used in television systems. A suitable black and white TV glass is the type manufactured and sold by Corning Glass Works of Corning, New York and identified as 008 black and white TV glass. A suitable color TV glass as manufactured by Corning is identified as No. 9040. The 9040 glass is particularly compatible with skirts made of the 2810NC or the 2810N metal sealing alloys above identified. The 008 Corning glass is particularly compatible for mounting with the metal sealing alloy 45–6, also above identified.

Base plate 11 made of glass is of about the same thickness as face plate 14, i.e., one-half inch. G1 grid 42 is about 0.001 inch thick. The spacing between the tip of cathode 40 and the rear face of the G1 grid is about 0.004 inch. The spacer 43 is about 0.005 inch thick. The G2 grid 44 is about 0.002 inch thick. The spacer 45 is about 0.002 inch thick. The G3 grid 46 is about 0.030 inch thick. The spacer 47 is about 0.005 inch thick. The G4 grid 48 is about 0.030 inch thick. The distance from the center of the G4 grid 48 and screen 103 is about 0.200 inch. The distance from the screen 103 to the screen 14*a* on face plate 14 is about 0.1000 inch.

From the outside, the elements appearing are the base plate 11 one-half inch thick abutted against the rear flange of skirt 100 with face plate 14 of one-half inch thickness spaced about one-quarter inch from the front face of base plate 11 and nested within the flanged end of skirt 100. The entire structure is about 1 ¼ inches thick and 10 inches in diameter, either circular or rectangular and has therein about 4,800 discrete beam forming-deflection systems as shown in FIG. 6.

The *x–y* deflection fields in the system of FIGS. 1–6 are produced by control of the elements in G4 grid 48. A preferred deflection G4 grid may be provided in accordance with the structures shown in FIGS. 7–10. In accordance with the structures of FIGS. 7–10, the deflection G4 grid may be characterized as a monolithic staggered mesh deflection system particularly suitable for use in flat matrix cathode ray tubes. The general concept of this system is shown in the exploded view of FIG. 7.

FIG. 7

The G4 deflection grid is formed of four layers of mesh. The four layers 111–114 are characterized by rectangular perforations in a thin metallic sheet having surface insulation thereon. The rectangular holes in the sheet have the same pitch as the gun structures of FIGS. 1–6, i.e., the holes would be centered at 0.1 inch intervals. The holes are square and have length and width about twice the size of the holes in the G4 grid 48 of FIGS. 1–6. Thus, a rectangular deflection sector indicated by the dotted outline 115 functionally corresponds with the holes in the G4 grid 48. It is through deflection sector 115 that the electron beam will pass. The sheets 111–114 are staggered relative to sector 115 so that only one side of each of the four mesh-like structures is located close to deflection sector 115. Deflection sector 115 occupies about one-third of the pitch of the mesh. For example, with reference to an initial position where all of the plates are perfectly aligned one with another and symmetrical to sector 115, the *x*1 deflection plate 111 is moved in direction of arrow 111*a* so that only one side of the opening 111*b*, the side 111*c* is tangent to sector 115. The side tangent to the deflection sector will thus be the only one of the four sides of the opening 111*b* which produces an effective deflection field. The sides adjacent and opposite to the side 111*c* will be effectively shielded by the other mesh elements. More particularly, the *y*1 deflection plate 112 is moved in the direction of arrow 112*a* so that only the side 112*c* is adjacent to sector 115. Similarly, the *x*2 sheet 113 is moved in the direction of arrow 113*a* so that only the side 113*c* is tangent sector 115. The *y*2 sheet is moved in the direction of arrow 114*a* so that only the side 114*c* is adjacent to sector 115.

Figure 7:
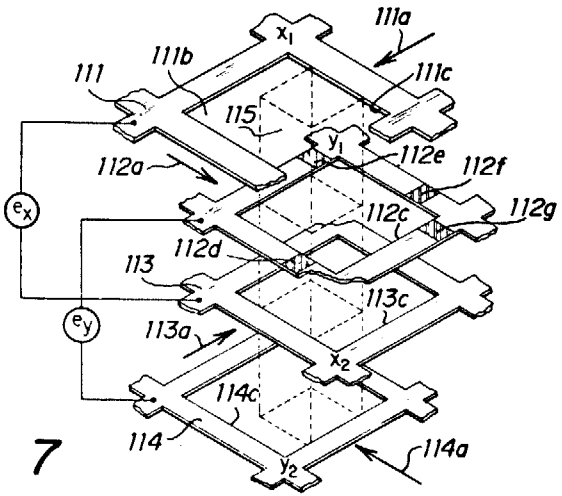

In practice, the sheets of the exploded view of FIG. 7 will form a solid stack in the staggered relation shown. As a result, there will be contact areas between adjacent sheets such as the areas 112*d*-112*g* which represent insulated contact zones between the *x*1 deflection plate 111 and the *y*1 deflection plate 112.

It will be understood that plates 111–114 are of dimension such as to be coextensive with the array of cathodes and beam forming structures such as shown in FIGS. 1–6 so that each of the beams in the system can be deflected by application of a deflection voltage ($e_X$) between sheets 111 and 113 and a deflection voltage ($e_Y$) between sheets 112 and 114.

FIG. 8

Figure 8:
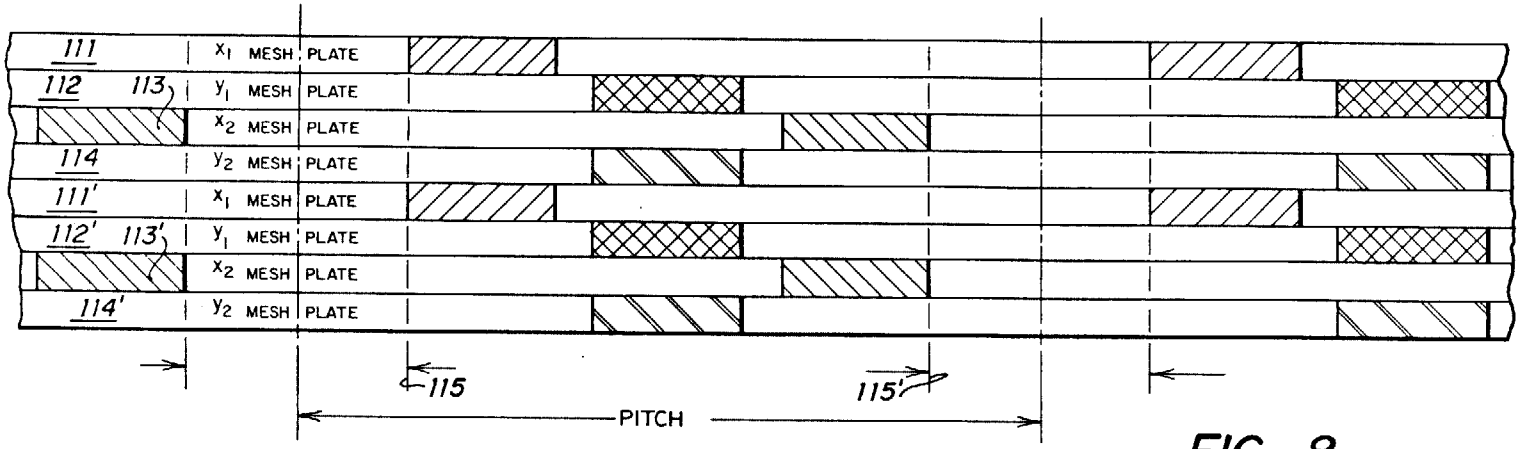

While only four plates are shown in FIG. 7, multiple sets of thin lamina preferably are employed in order to make up the total G4 deflection electrode. Such a structure is illustrated in FIG. 8 where two such sets are shown forming a stack where the top set of plates 111–114 overlay a second set of plates 111′–114′. Insulation between the sheets is not shown but is provided as indicated in FIG. 7. The deflection sector 115 in the *x* direction has the *x* plates 111 and 111′ adjacent one edge and the *x*2 plates 113 and 113′ adjacent the opposite edge. In a similar manner, the *y*1 and *y*2 plates are staggered relative to sector 115. A second deflection sector 115′ is also shown with the edges of plates in the same relationship as with respect deflection sector 115. In such a stack, all of the *x*1 deflection plates would be electrically connected together as would all of the *y*1, *x*2 and *y*2 deflection plates. They would be excited in the manner generally shown in FIG. 7. The multi set stack of deflection plates such as shown in FIG. 8 has an advantage over a single set in that it provides larger deflector surface area and thus more sensitivity for a given deflection voltage.

FIG. 9

Figure 9:
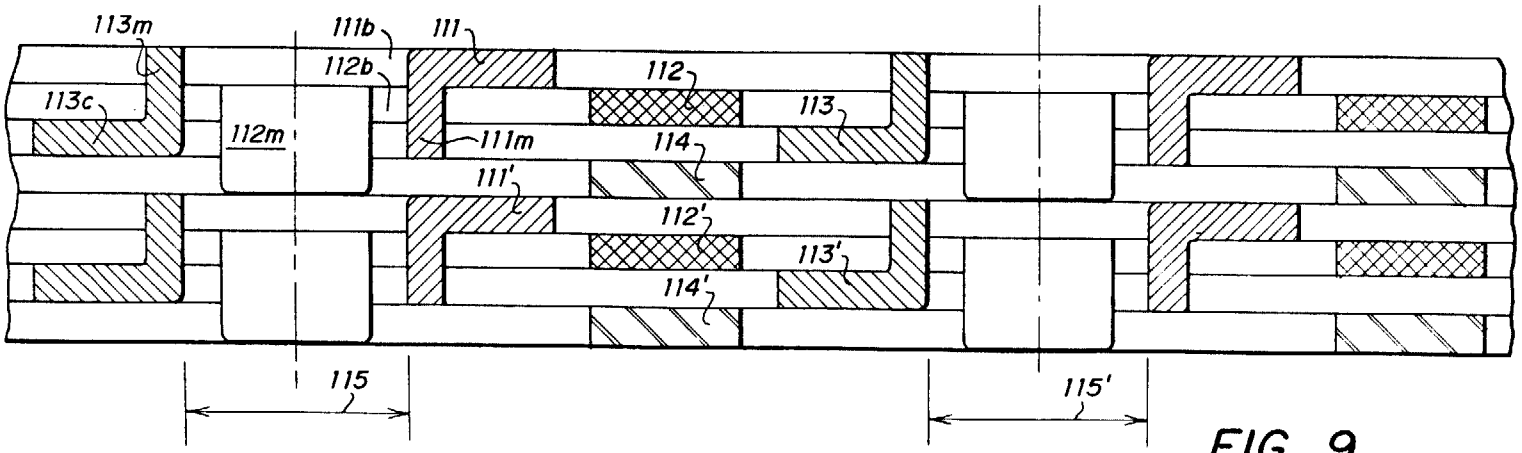

In FIG. 9, a multi set stack of perforated metal sheets is shown forming the G4 deflection electrode in which better shielding for the various deflector buses is provided with increased surface area to enhance sensitivity. More particularly, the *x*1 deflector plate 111 is provided with a downturned flange 111*m* on the side 111*c* of the opening 111*b* which is tangent to sector 115. In a similar manner, the plate 112 has a flange 112*m* extending along the portion of the opening 112*b* which is tangent to the sector 115. Flange 112*m*, like flange 111*m*, is downturned. Plate 113 has an upturned flange 113*m* extending across a portion of the side 113*c* which is tangent to the sector 115. In a similar manner, plate 114 will have a flange (not shown) which is upturned tangent to sector 115 on the side opposite the flange 112*m*. The above geometry is then repeated for the sheets 111'–114' and successive sets in the stack. The same flange structure is provided adjacent to the sector 115'.

FIG. 10

Figure 10:
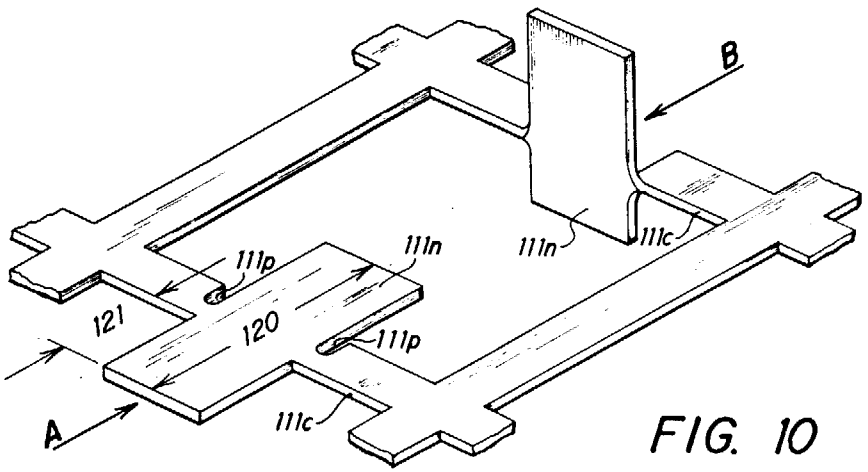
FIGS. 7–10 illustrate alternative deflection structures.

FIG. 10 illustrates one system for forming the deflection plates on one side of each opening in the sheets employed in the G4 deflection electrode. A fragmentary portion of the plate 111 is shown with the sides 111*c* each having transverse bars 111*n* formed thereon. Notches 111*p* are formed from edges opposite the edge 111*c*. The transverse plates 111*n* initially are flat, lying in the plane of the plate 111. However, they are rotated 90°. All of the plates may be formed and oriented with the transverse bars 111*n* 90° one with respect to the other. The length 120 of the transverse bars may be constant. The distance from the tangent face 111*c* to the end of the bar, i.e., the distance 121 may be varied for the four mesh plates such as to maintain the same actual position of the four deflectors. In such case, with the transverse deflector bars of sufficient length, a single set of plates would be employed. The plates may be stamped and formed, etched and formed or electro formed. Thus, deflection of each of the cathode ray beams is made possible by using a laminate of conductive unipotential meshes separated by an insulator suitable for vacuum application. The insulators can be of a glass frit. The laminate can be composed of a single or multiple iteration of sets of four plates for the desired quadrature deflection. It will be noted that the contact areas between adjacent members occupy a very small portion of the total surface area. The area where the dielectric constant is high is thus reduced and therefore the inter electrode capacitance is lowered. Furthermore the remaining mesh areas are physically separated from each other with low dielectric constant (vacuum) therebetween further reducing inter electrode capacitance.

In a system of the type shown in FIG. 6, the switching voltage on the G1 grid 42 as above noted would be of the order of 15 to 30 volts. The switching voltage on the G2 grid 44 would be of the order of 75 to 150 volts. The voltage on the G3 predeflection drift space grid 46 would be held constant at a value equal to the maximum value of the switching voltage on the G2 grid 44. Similarly, the isolation mesh 130 would be maintained at about the same voltage as on the G3 grid 46.

From the foregoing, it will be seen that a flat cathode ray tube device is provided for displaying information in response to multiple electron beams on a phosphor coating on a face plate. A monolithic structure is provided including an *x*–*y* matrix of electron source cathodes with a pair of grids successively spaced from the matrix with holes therethrough adjacent to and aligned with the cathodes selectively to form and individually control the intensity of an electron beam from each of the cathodes. A deflection control structure is provided having holes through which the beams may pass with a set of *x*–*y* deflection electrodes associated with each of the holes for *x*–*y* control of the trajectory of each of the beams. In FIG. 2 it will be noted that the tip of the cathode is within the limits of the G1 grid 42. In FIG. 6, the tip of the cathode is located behind the G1 grid. The latter structure is preferred inasmuch as the control of the G1 grid is more readily affected than in the case of FIG. 2.

By way of example, specific parameters have been indicated for the embodiments of the invention herein described. Having described particular embodiments, further modifications may now be made by those skilled in the art and it is intended not to be limited by the specific parameters or embodiments herein described except as set out in the appended claims.

What is claimed is:

1. A cathode structure for a multibeam cathode ray tube comprising:

a. an elongated conductor having a peaked riser flanked on each side by deviated portions lying in a common plane perpendicular to the plane of said riser, b. structure at the peak of said riser for enhancing electron emission therefrom upon current flow through said conductor, and c. planar monolithic conductive structure contacting said deviated portions on said elongated conductor that forms paths for current flow to and from said risers.

2. A cathode structure for a multibeam cathode ray tube comprising an elongated conductor having a plurality of peaked risers each flanked on each side by laterally deviated portions lying in a common plane perpendicular to the plane of said risers, and structure at the peak of each said risers for enhancing electron emission therefrom upon current flow through said conductor.

3. The combination set forth in claim 2 wherein separate conductive means contact said deviated portions of said elongated structure that forms paths for current flow to and from each of said risers.

4. The combination set forth in claim 2 in which said laterally deviated portions are contacted to separate conductive pads at said plane to provide multiple paths for current flow in the regions of said laterally deviated portions.

5. The combination set forth in claim 4 in which a plurality of said elongated conductors are arranged in a side by side relation having said laterally deviated portions in a common plane with the spacing between said conductors equal the distance between risers on a given conductor to form an *x*–*y* matrix of electron sources.

6. The combination set forth in claim 5 in which conductive pads extend generally perpendicular to said conductors to support said laterally deviated portions in regions between said risers.

7. The combination set forth in claim 6 in which a guide plate extends in a plane parallel to the plane of said conductive pads on the side of said conductors opposite said pads with guide structure engaging and directing said risers.

* * * * *